United States Patent [19]

Petren

[11] 4,253,549

[45] Mar. 3, 1981

[54] METHOD AND A SYSTEM FOR THE ERECTION OF HIGH BUILDINGS

[76] Inventor: Rolf A. M. Petrén, Jerkholmen 609, Hovås, Sweden

[21] Appl. No.: 954,641

[22] Filed: Oct. 25, 1978

[30] Foreign Application Priority Data

Nov. 15, 1977 [SE] Sweden ..... 7712904

[51] Int. Cl.[3] ..... E04G 3/00

[52] U.S. Cl. ..... 182/150; 182/82; 52/745

[58] Field of Search ..... 182/150, 178, 179, 187, 182/82, 142, 113; 52/745, 741

[56] References Cited

U.S. PATENT DOCUMENTS

| | | | |
|---|---|---|---|
| 1,484,480 | 2/1924 | Donaggio | 182/150 |
| 2,043,128 | 6/1936 | Sutton | 182/187 |
| 3,393,769 | 7/1968 | Springer | 182/150 |
| 3,957,240 | 5/1976 | Johansson | 182/82 |
| 4,068,738 | 1/1978 | Reed | 182/150 |

*Primary Examiner*—Reinaldo P. Machado

*Attorney, Agent, or Firm*—Frishauf, Holtz, Goodman & Woodward

[57] ABSTRACT

The invention concerns a scaffolding system for use at the erection of high buildings and solves the problem of providing a suspended scaffold which is stepwise lifted to higher levels but yet in constant communication with ground level. The patented system comprises two scaffold categories the one (1) being permanently directly accessible from ground and the other (2, 3) being successively lifted to higher levels and, between the lifting operations, held suspended from the building itself rather than from lifting cranes.

8 Claims, 7 Drawing Figures

METHOD AND A SYSTEM FOR THE ERECTION OF HIGH BUILDINGS

THE INVENTION

At the erection of high buildings and similar constructions there does generally exist a need for having a possibility to work from a plurality of different levels between ground and the roof of the building. The conventional way of solving that problem has, since many hundred years, been to use scaffolds which rest on the ground level and the height of which is successively increased in pace with the completion of the building. That methods has several disadvantages, the following two being the most important ones.

The first disadvantage is that the scaffold requires a large amount of materials. Secondly, the lower parts of the scaffold must be dimensioned so as to be able to support considerable weights. It belongs to the art to avoid those disadvantages by using a hanging scaffold suspended from a hoisting crane and, with the aid of the crane, successively lifted upwards. It is, however, for two reasons disadvantageous to use such a hanging stage. The one reason is that it is very difficult to protect the scaffold from swinging and rotational movements. The second reason is that a hoisting crane is kept occupied by each scaffold for all of the time period during which the scaffold must be used.

The object is to provide a method for the etection of high buildings which, as compared to prior art methods, is much more ecomonical and completely satisfactory in terms of protection of the workers.

The invention is based on the following realization. When a building is erected according to modern methods, in which the bottom floors are completely finished before construction of the top floors has even been initiated, there is no need of having access to a scaffold which, during all of the erection period, extends around all of the building from the ground and upwards. Instead, it is sufficient to have scaffolds which, in the vertical direction, cover just the zone of the building within which work is going on. This means that the scaffold must successively be moved upwards. As has already been mentioned, it does per se belong to the art to solve these problems by means of scaffolds suspended from cranes. The invention does, however, elimminate the continuous need for cranes by suggesting the use of scaffolds which, during the progress of the work, are suspended from fastening means secured at the building. This means that the cranes have to be relied upon only during the very short periods when a scaffold is to be moved to a higher level. At all other times the cranes are available for other types of work. Thanks to the fact that the scaffold is suspended from the building rather than from a hoisting crane, the instability problem is also solved, which will be explained below.

To let the building under construction itself support a suspended scaffold rather than having it suspended from a crane is accordingly a novel feature. The reason why this principle has not been utilized before is probably that it has been considered necessary to conserve the possibility, by means of hoisting cranes, periodically to lower the scaffold down to ground level so that the workers may embark and debark. It could consequently be said that the present invention has overcome a prejudice by offering another solution to the access problem, a solution based on the realization that it is completely sufficient that a minor portion of the scaffold only, as seen in the circumferential direction of the building, extends down to the ground level. That minor portion, which can be subdivided into two or more parts, offers a continous connection with ground, basically in the same way as at the classical scaffold type above referred to. However, the final result is that the costs for procuring, mounting, using and demounting the scaffold will be much lower than according to any of the prior art methods. The parts of the scaffold which are in continuous connection with the ground level may be constituted by conventional scaffolds but, according to a preferred embodiment of the invention, they are also constituted by suspended scaffolds comprising several sections. When the height of such a scaffold portion is to be increased, a further section is, by means of a crane, added to the uppermost one of the existing sections. The number of working stages making up each scaffold may vary. The stages can be interconnected via rigid members, such as tubes or the like. However, the interconnection members are preferably constituted by chains.

One embodiment of the invention will now be described with reference to the drawing.

FIG. 1 is a perspective view diagrammatically showing a protion of the framework of a building under erection. The framework is constituted by steel beams.

FIG. 2 corresponds to FIG. 1 but shows the building skeleton at a later stage.

FIG. 3 is a perspective view showing, on a larger scale, two platforms of a suspended scaffold.

FIG. 3*a* is a detailed view of the connection shown at a in FIG. 3;

FIG. 3*b* is a detailed view of the platform at b in FIG. 3;

FIG. 3*c* is a detailed view of the chain arrangement at c in FIG. 3;

FIG. 3*d* is a detailed view of the chain hanger arrangement at d in FIG. 3.

Figure 1:
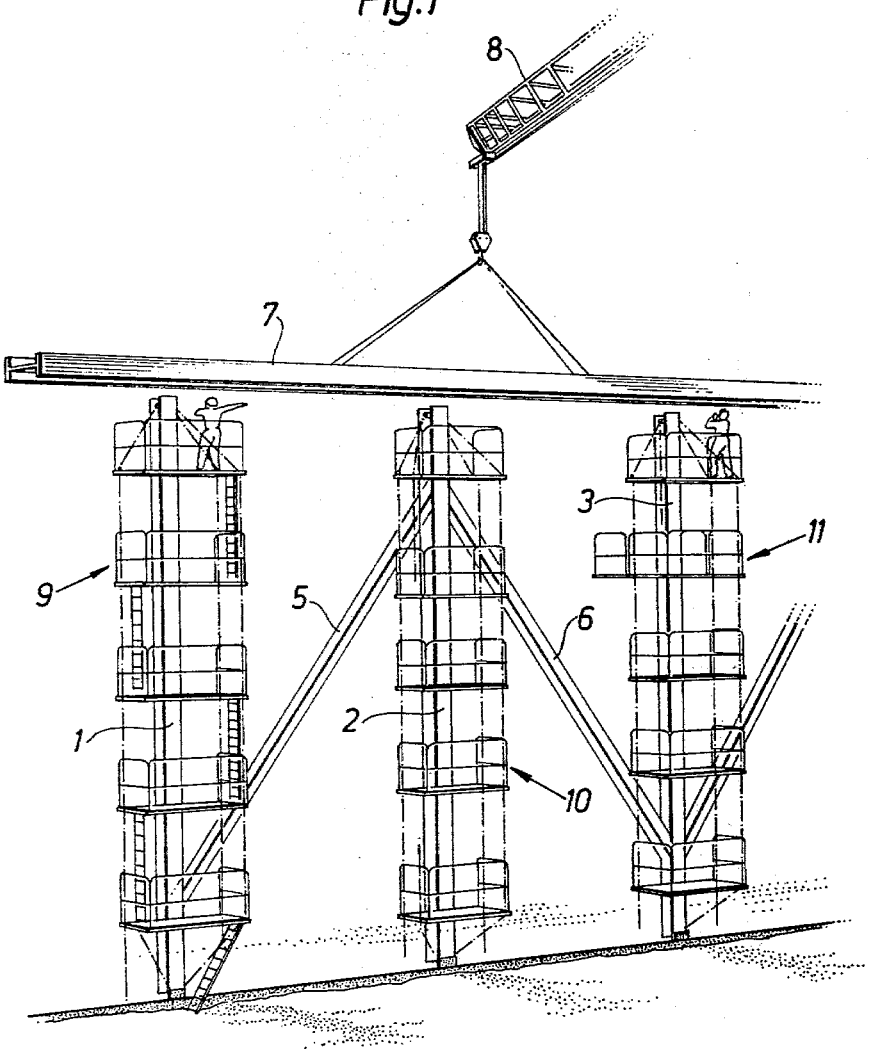

FIG. 1 does accordingly show a portion of a building skeleton under erection. The portion illustrated comprises three vertical steel columns 1, 2 and 3, secured in ground foundations and laterally stabilized by means of diagonal girders 5 and 6. The upper ends of the vertical columns are to be interconnected by means of a wide H-beam 7 suspended from the arm 8 of a hoisting crane.

In front of each of columns 1, 2 and 3, also referred to as column sections, there is a scaffold 9, 10 and 11, respectively. At least two of the scaffolds, here 10 and 11, are of the suspended type. However, according to the embodiment here selected, also scaffold 9 is identical with the two other ones. Further, also in conformity with the preferred embodiment, the various platforms are interconnected by means of chains. The way in which those chains have been secured to the frame of the building and to the platforms appears from FIG. 3 to which further reference will be made below. As appears from the drawing, each suspended scaffold section does in this case comprise five working platforms. However, as is understood, the number of platforms may vary as called for by the local conditions. The lowermost platform of scaffold 9 has a ladder 12 the bottom end of which rests against ground. It should be noted that, during all of the construction period, this scaffold section will remain in one and the same position.

Figure 2:
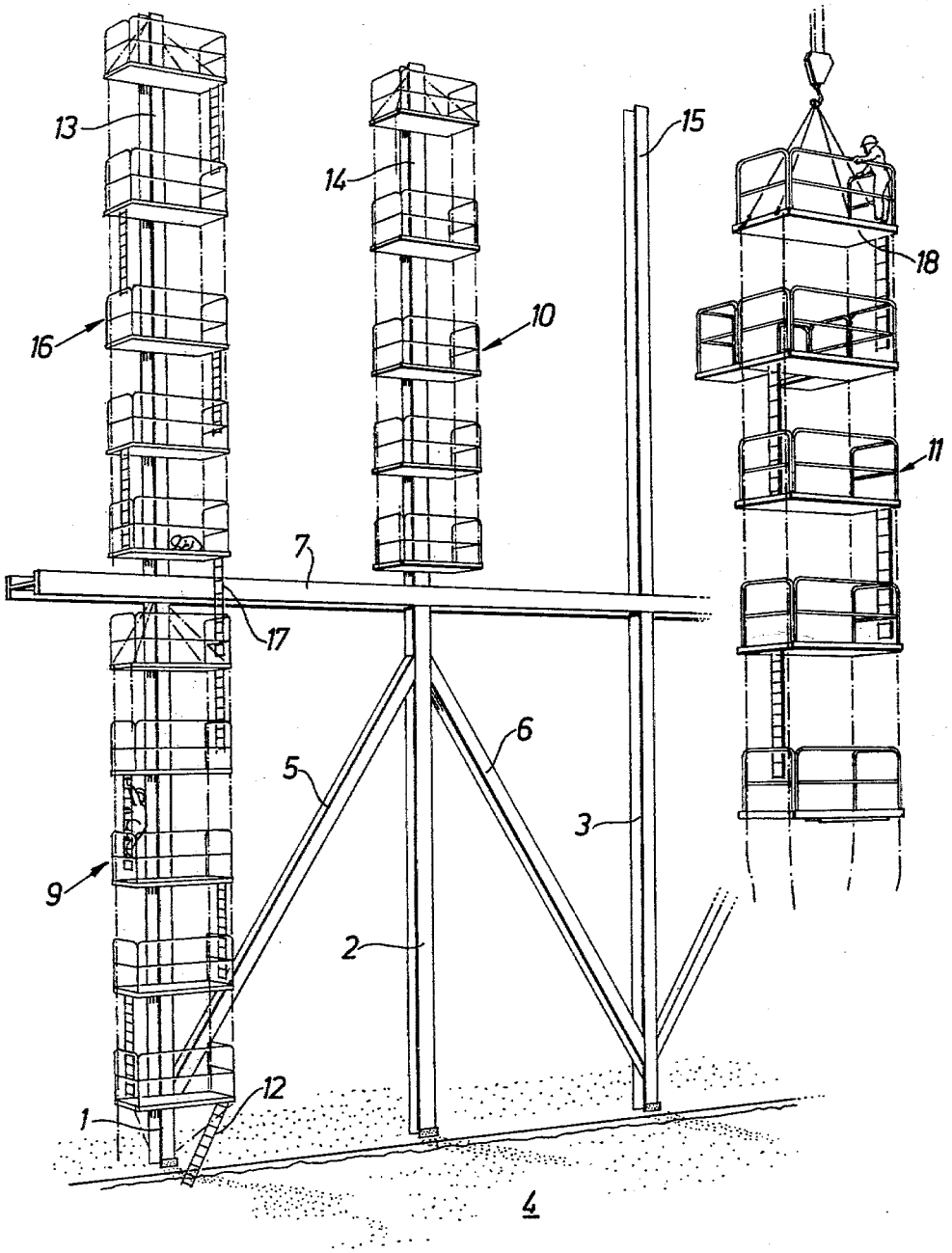
Figure 3A:
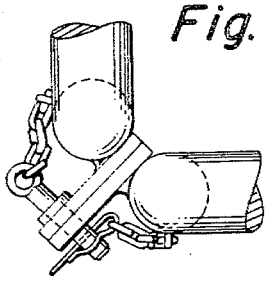
Figure 3B:
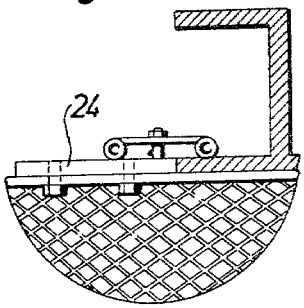
Figure 3C:
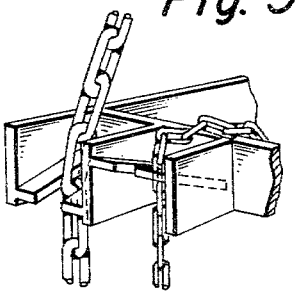
Figure 3D:
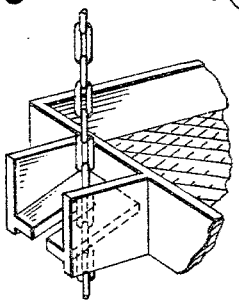
Figure 3D:
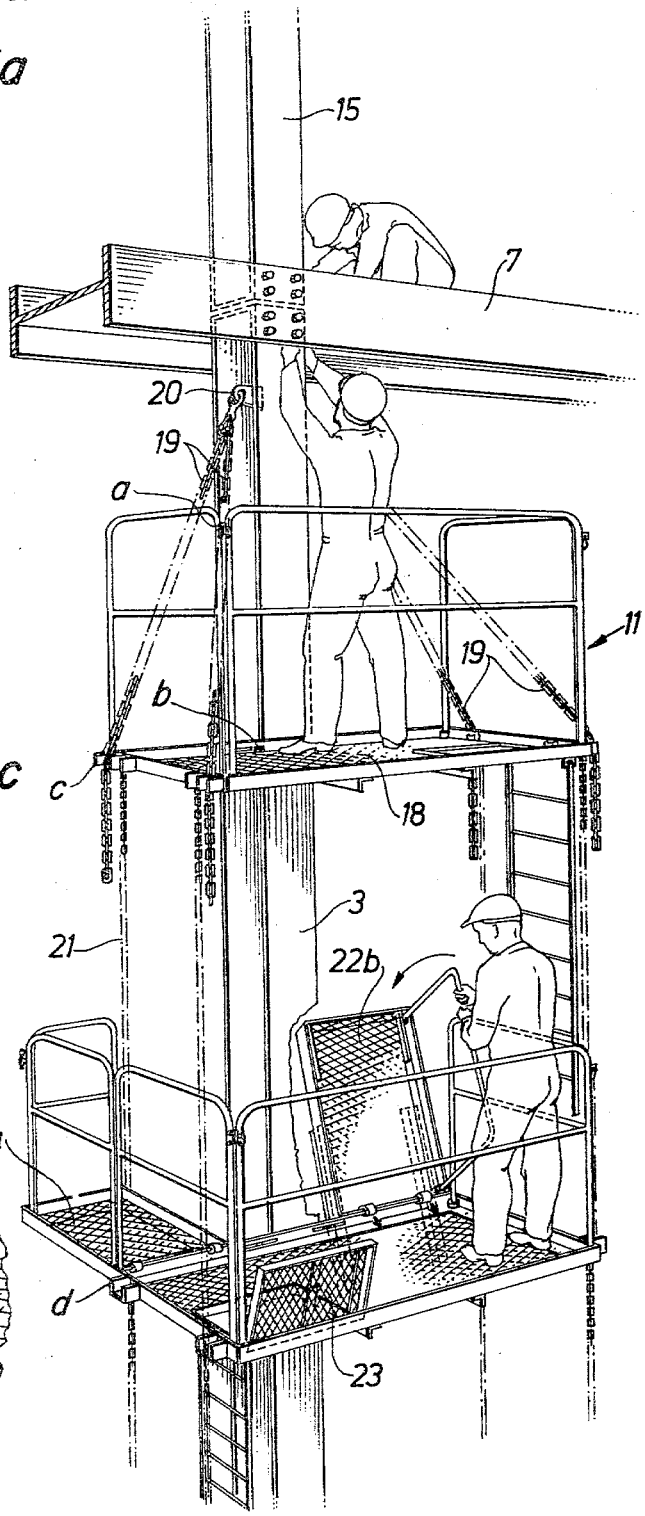

In contrast thereto, scaffold sections 10 and 11 are successively moved upwards in pace with the completion of the building. This is apparent is from FIG. 2 illustrating that above the horizontal beam 7 and directly opposite column sections 1, 2 and 3 further column sections 13, 14 and 15 have been installed. The top end of column section 13 supports a suspended scaffold section 16, the lowermost platform of which is, via a ladder 17, connected to the uppermost platform of scaffold section 9. At the central column 2, 14 scaffold section 10 has been moved from the position in FIG. 1 to a position above horizontal beam 7. This has been made by means of a crane and FIG. 2 illustrates that scaffold section 11 serving the third column 3 and 15 is in the process of being lifted to the corresponding higher level.

FIG. 3 refers to column 3, 15 and shows the position of scaffold 11 before it has been lifted to the higher level but after installation of beams 7 and 13–15. The uppermost platform 18 is carried by four chains 19 forming flexible suspension members the upper ends of which are pairwise secured to fasteners 20 welded to beam 3. Only one of those fasteners is visible on the drawing. The magnified picture within the next lowermost circle illustrates how the chains are connected to platform 18. Adjacent to each of the four platform corners there is a member capable of retaining the chain in an easily removable but perfectly safe manner. Corresponding devices are previously known through my British Pat. No. 1,461,651, to which reference is now made. The picture within the lowermost circle illustrates a member receiving one of the four chains 21 which interconnect the other platforms.

Figure 4:
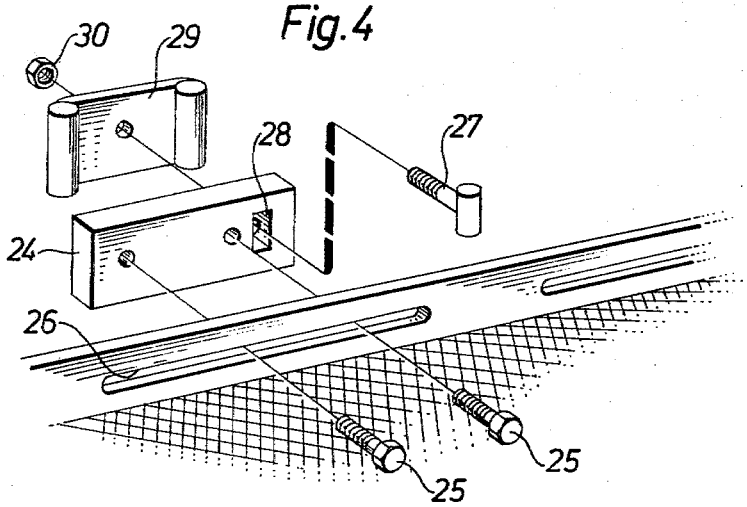
FIG. 4 is an exploded perspective view showing the detailed arrangement of the device within the next but one uppermost circle in FIG. 3.

The picture in the next uppermost circle illustrates means for fixation of a platform to the column 3 for the purpose of preventing the platform from rotating or swinging. The corresponding device, the detailed design of which is shown in FIG. 4, consists of a spacing member 24 retained by two bolts 25. The bolts pass through an elongated groove 26 in the frame of the platform, thereby making spacer 24 horizontally displaceable so as to match column beams having flanges of different widths. As shown in the picture in the circle, spacer 24 is brought into contact with the edge of the beam flange which has substantially the same thickness. By means of a T bolt 27, the head of which is located in a recess 28 in spacer 24, a clamping plate 29 is kept pressed against the beam flange and against the spacer. The corresponding pressure is generated by the tightening of a nut 30 carried by bolt 27. Member 29 is preferably at both ends provided with special contact ridges.

Figure 5:
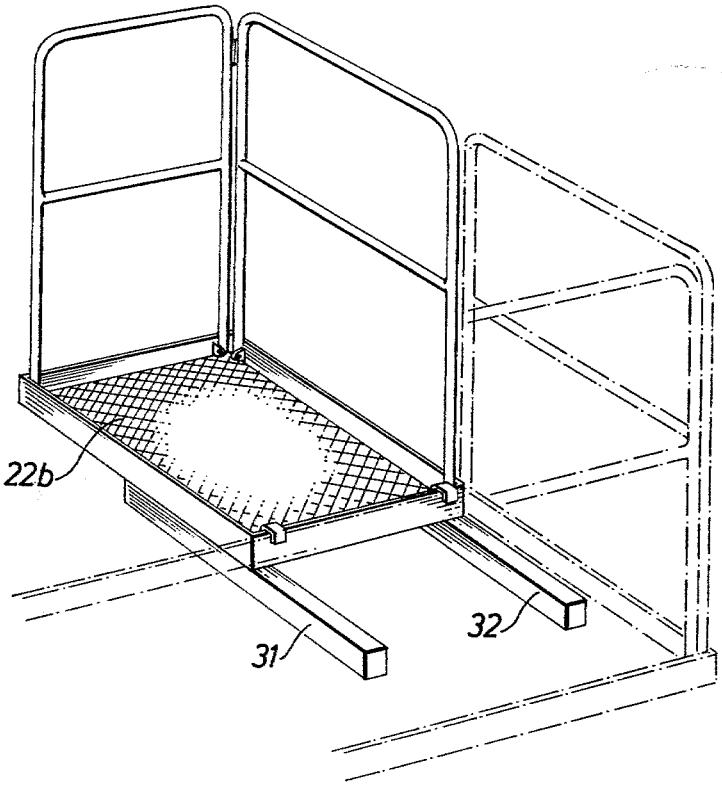
FIG. 5 is a perspective view showing a removable platform part.

The difference between the lower platform 22 and the upper platform 18 in FIG. 3 is that the first-mentioned platform has two floor sections **22*a* and 22*b* which may be folded down on opposite sides of beam 2, thereby increasing access to the beam. Those foldable platform sections have foldable or demountable fences and they are swingable around shafts secured to the upper edge of the frame surrounding the floor of each platform. FIG. 5 shows a simple way of guaranteeing that a foldable platform section 22*b* is automatically halted in its horizontal position and prevented from continued rotation. The corresponding device consists of two supporting rails 31, 32 secured to the bottom of section 22*b* and projecting backwards therefrom. When section 22*b*** has been folded to its horizontal position, they will be in contact with the bottom of the main portion of the platform.

The picture within the uppermost circle in FIG. 3 illustrates a device for releasable interconnection of the fence portions. This makes it possible, when the scaffold is not used, to remove or swing down the fences, preferably so that they are completely received within the frame of each platform. This makes it possible to place a plurality of platforms on top of each other so that they form a very compact unit which may conveniently be transported.

Figure 6:
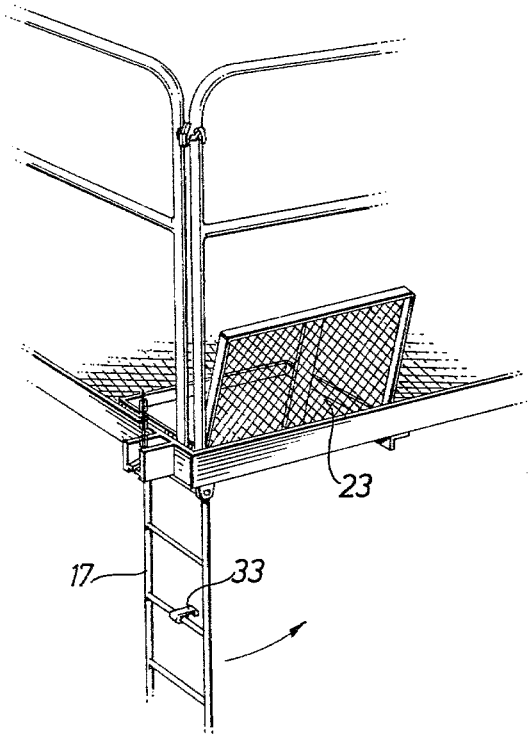
FIGS. 6 and 7 are a perspective view and a vertical section, respectively, illustrating a safety device for ladders interconnecting the various platforms.
Figure 7:
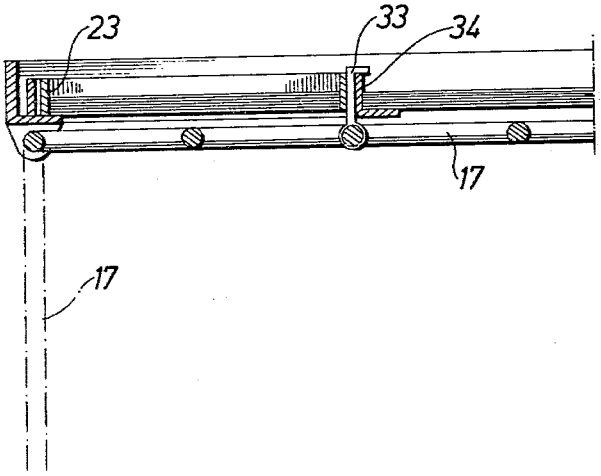

Numeral 23 in FIGS. 3, 6 and 7 designates a trap door adjacent one of the corners of platform 22. The ladders are mounted below each platform as shown at platform 18 in FIG. 3. When the scaffold is not used, the ladders are stored in a horizontal position below the related platforms. This has been shown in FIG. 7, also illustrating that one of the rungs of the ladder carries a latch 33 which, when trap door 23 is closed, engages the upper edge of the frame 34 surrounding the door opening. Accordingly, when door 23 is swung open, ladder 17 is still positioned below the opening, thereby offering a protection against somebody falling through the opening. As is understood, each ladder cannot be swung downwards to its position in FIG. 6 until latch 33 has been released. A further advantage is that the ladders occupy very little vertical space when the scaffold is not used and its different platforms stored on top of each other.

As has been mentioned above, according to a preferred embodiment of the invention, the platforms are interconnected by chains. It should, however, be underlined that in other embodiments of the invention the chains are replaced either by other flexible means, such as wires, or by rigid interconnections, especially tubes. Corresponding modifications can be made also as far as the other components of the system are concerned.

What is claimed is:

1. In a method of erection of a high building, or the like, having a plurality of superimposed floor levels, and a plurality of vertically extending columns (1, 2, 3) located at horizontally spaced locations, and using a scaffold, the steps of:

(a) placing a base scaffold unit of at least two floor heights and having interconnected platforms along one column, said base scaffold unit being accessible from the ground;

(b) extending the height of the scaffold along said one column by adding a sequential scaffold unit on said base scaffold unit, as the height of the column is increased during construction of the building;

(c) placing a further scaffold unit of at least two floor level heights and having interconnected superimposed platforms along another column;

(d) securing the uppermost platform of the further scaffold unit on the other column;

(e) then, as the height of the other column is increased during construction of the building, hoisting said further scaffold unit up the other column;

and repeating steps (a), (b), (e) and (d) during further construction of the building to move the other scaffold unit upwardly as the height of the building increases during construction, while providing ground level communication via the sequentially increasing scaffold units along said one column.

2. Method according to claim 1, wherein the platforms are interconnected by flexible suspension elements;

and wherein the step of securing the uppermost platform to any column comprises suspending said uppermost platform from the associated column by said flexible suspension members.

3. Method according to claim 2, wherein the flexible suspension members are chains.

4. Method according to claim 1, wherein all the suspension units are similar.

5. Scaffolding system for use in the erection of a building, or the like, having a plurality of superimposed floor levels, in which the building, in construction, includes a plurality of vertically extending columns located at horizontally spaced locations, comprising a plurality of scaffold units, each scaffold unit being at least of two floor level heights and having interconnected platforms, one scaffold unit forming a base scaffold unit and being placed along one column, and superimposed scaffold units being placed on said base scaffold unit;

and at least one further scaffold unit of at least two floor level height and having interconnected platform units secured to another beam intermediate the length thereof and spaced from ground level, said other platform unit having releasable attachment means secured to the upper platform of the further scaffold unit and to the associated column;

and means to hoist the other platform unit up the other beam, ground communication for workers on the other platform unit being provided by the superimposed platform units along the said one beam accessible from ground level.

6. Scaffolding system according to claim 5, wherein the flexible interconnection means comprise chains.

7. Scaffolding system according to claim 5, wherein each platform has at least one foldable floor portion for use when the platform is located adjacent a vertical column.

8. Scaffolding system according to claim 5, wherein all said scaffold units are essentially similar.

* * * * *